US009132935B2

(12) United States Patent
Carroll

(10) Patent No.: US 9,132,935 B2
(45) Date of Patent: Sep. 15, 2015

(54) ASSEMBLY AND METHOD FOR CREATING CUSTOM THREE-DIMENSIONAL STRUCTURES FROM PRINTABLE BLANK SHEETS

(75) Inventor: Benjamin T. Carroll, Brooklyn Park, MN (US)

(73) Assignee: Blank Acquisition, LLC, Brooklyn Park, MN (US)

( * ) Notice: Subject to any disclaimer, the term of this patent is extended or adjusted under 35 U.S.C. 154(b) by 200 days.

(21) Appl. No.: 13/612,198

(22) Filed: Sep. 12, 2012

(65) Prior Publication Data

US 2014/0069994 A1 Mar. 13, 2014

(51) Int. Cl.

| | |
|---|---|
| ***B65D 5/42*** | (2006.01) |
| ***B65D 5/02*** | (2006.01) |
| ***B31B 1/00*** | (2006.01) |

(52) U.S. Cl.

CPC ..... *B65D 5/0254* (2013.01); *B31B 1/00* (2013.01); *B65D 5/4216* (2013.01); *B65D 5/4266* (2013.01); *B31B 2201/26* (2013.01); *B31B 2201/88* (2013.01); *B31B 2203/066* (2013.01); *B31B 2203/084* (2013.01)

(58) Field of Classification Search

USPC ..... 229/237; 40/312; 428/43

See application file for complete search history.

(56) References Cited

U.S. PATENT DOCUMENTS

| | | | | |
|---|---|---|---|---|
| 3,598,303 | A * | 8/1971 | Folz | 229/101 |
| 4,735,356 | A * | 4/1988 | Engel | 229/103 |
| 5,071,062 | A * | 12/1991 | Bradley et al. | 229/109 |
| 5,538,288 | A | 7/1996 | Heath | |
| 5,571,587 | A | 11/1996 | Bishop et al. | |
| 5,853,837 | A | 12/1998 | Popat | |
| 6,117,061 | A | 9/2000 | Popat et al. | |
| 6,257,404 | B1 | 7/2001 | Tracy et al. | |
| 6,279,821 | B1 | 8/2001 | Kubitsky et al. | |
| 6,440,050 | B1 * | 8/2002 | Capparelli et al. | 493/59 |
| 6,845,864 | B2 | 1/2005 | Taw et al. | |
| 6,966,483 | B2 * | 11/2005 | Manninen | 229/103 |
| 2005/0082356 | A1 * | 4/2005 | Shadrach | 229/120.03 |
| 2008/0000118 | A1 * | 1/2008 | Suzuki | 40/312 |

OTHER PUBLICATIONS

Relyco, DigiPOP Packaging Solutions, http://www.relyco.com/en/Products/DigiPOP%20Packaging%20Solutions.aspx, May 21, 2012, 6 pages.

* cited by examiner

*Primary Examiner* — Christopher Demeree
*Assistant Examiner* — Phillip Schmidt
(74) *Attorney, Agent, or Firm* — Kinney & Lange, P.A.

(57) ABSTRACT

A printable blank comprises a sheet with a with outline perforation lines defining a periphery of an object. The sheet is capable of being passed through a printer to have an image printed on it. The sheet also comprises run-out perforation lines extending from the periphery to edges of the sheet, wherein the sheet can be folded along the run-out perforations to detach the object from the sheet. A method for creating custom print structures includes running a printable blank sheet through a printer and then bending the sheet along run-out perforation lines to detach an object from the sheet. The object can then be folded along scored fold lines to assemble it into a three-dimensional structure.

5 Claims, 7 Drawing Sheets

ASSEMBLY AND METHOD FOR CREATING CUSTOM THREE-DIMENSIONAL STRUCTURES FROM PRINTABLE BLANK SHEETS

BACKGROUND

The present invention relates to printable blank sheets for running through a printer, and in particular, to printable blank sheets that are capable of being formed into custom three-dimensional structures.

Custom print materials have become a common way for businesses to market themselves. Custom print materials that are typically used in advertising include two-dimensional products like postcards, flyers and door hangers, as well as three-dimensional products like golf ball boxes, candy boxes and pop-up calendars. Typically, custom print materials are sent to print shops that specialize in preparing custom print materials, as the materials have had to be printed and assembled by specialized machines. As a result, having custom print materials made can be costly and time-consuming.

Some printable blank templates are currently available for creating custom print three-dimensional materials without having to send them to print shops. These templates are die-cut with perforations and scored lines. The perforations surround the desired shape of the object and the scored lines indicate where the object should be folded to create a three-dimensional structure. The drawback to the currently available die-cut templates is that it is hard to detach the desired object from the excess sheet. It is difficult to fold the templates along the perforations due to the irregular placement of the perforations, thus the perforations are not weakened before they are torn apart. Trying to separate the perforated lines before weakening them often causes tearing of the object, which affects the strength and image of the resulting three-dimensional structure.

SUMMARY

According to the present invention, a printable blank comprises a sheet with outline perforation lines defining a periphery of an object. The sheet is capable of being passed through a printer to have an image printed on it. The sheet also comprises run-out perforation lines extending from the periphery to edges of the sheet, wherein the sheet can be folded along the run-out perforations to detach the object from the sheet.

A method for creating custom print structures includes running a printable blank sheet through a printer and then bending the sheet along run-out perforation lines to detach an object from the sheet. The object can then be folded along scored fold lines to assemble it into a three-dimensional structure.

DETAILED DESCRIPTION

In general, the present invention relates to printable blank sheets for creating custom three-dimensional structures. An outline of an object on the sheet is surrounded by perforations to help remove the object from the sheet. The sheet is capable of being run through a printer or a copier to have a custom image printed on it. The sheet is then capable of being folded back and forth along run-out perforations to help remove the excess sheet areas from the object. The object can be detached from the sheet and folded along scored lines to be formed into a three-dimensional structure.

Figure 1:
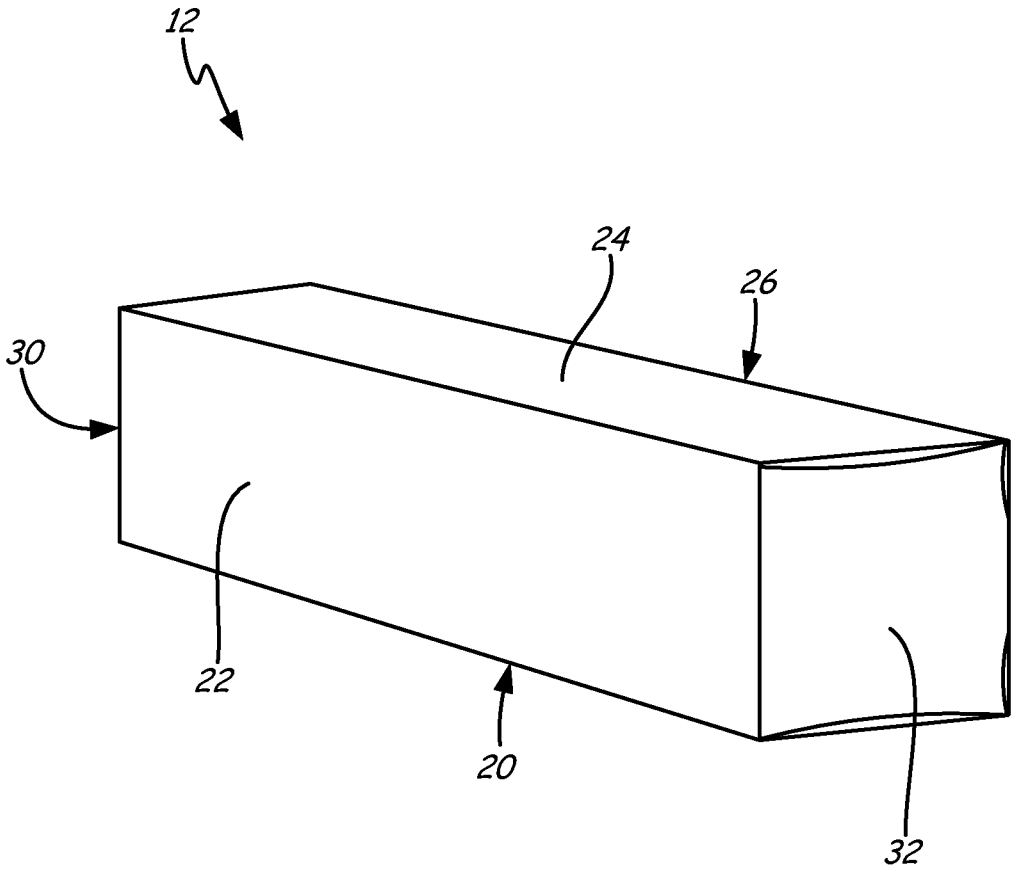
FIG. 1 is a perspective side view of a golf ball box.

FIG. 1 is a perspective side view of golf ball box 12. Box 12 includes side faces 20, 22, 24, and 26, and end faces 30 and 32. Side face 20 is connected to side face 22. Side face 22 is connected to side face 20, side face 24, end face 30 and end face 32. Side face 24 is connected to side face 22 and side face 26. Side face 26 is connected to side face 24.

Golf ball box 12 is formed by bending a flat box into a three-dimensional structure that is capable of holding golf balls. Side face 26 and side face 20 are attached with tabs and die-cut lines. End face 30 and end face 32 can be opened and closed so that golf balls can be placed in and taken out of golf ball box 12. Forming box 12 from a flat allows for individual customization of box 12, by providing a way to print a custom image on box 12 before it is assembled. This allows businesses to create their own custom print marketing materials at a lower cost.

Figure 2A:
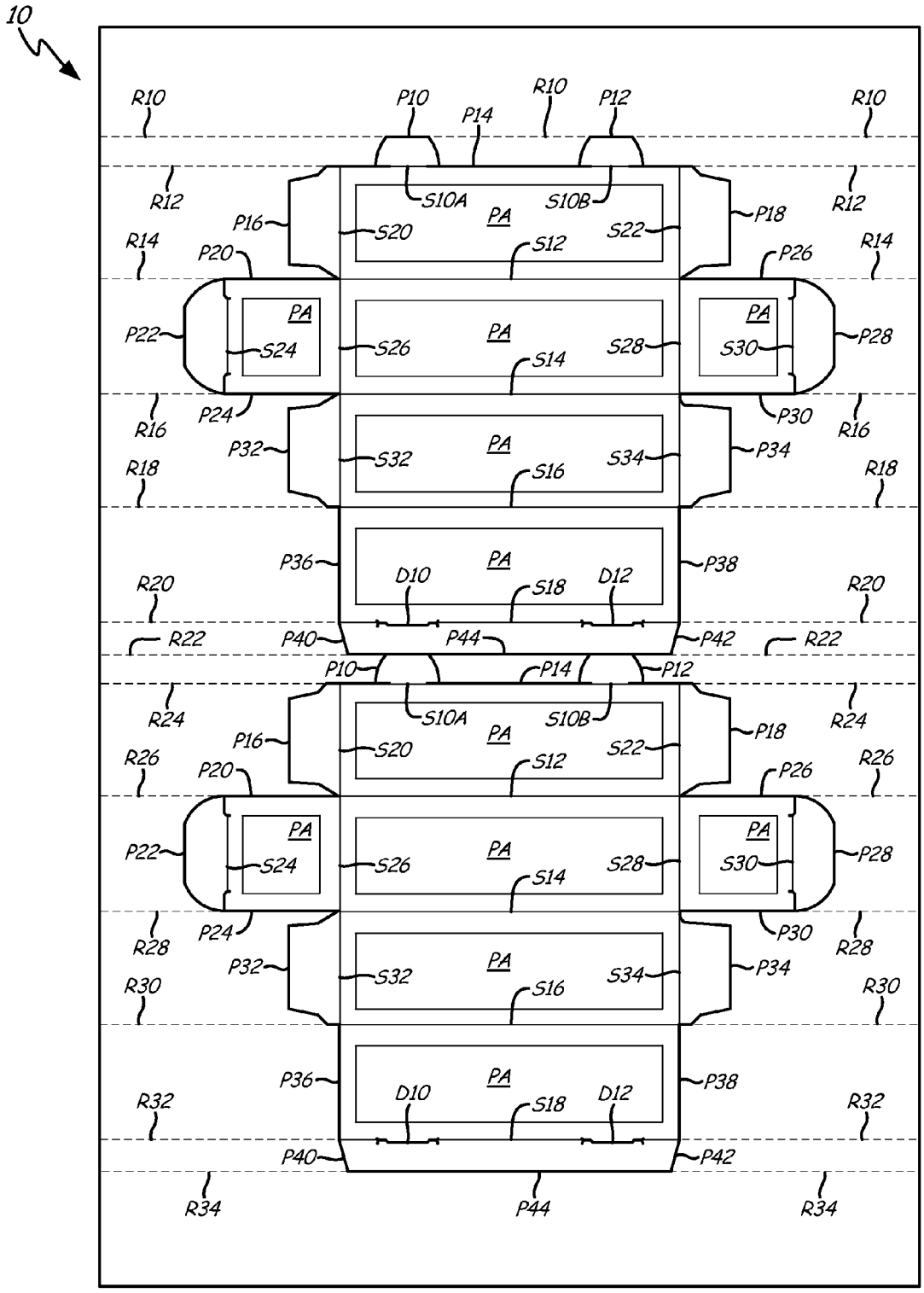
FIG. 2A is a top view of a printable blank sheet having perforations, scored lines and die-cut lines.
Figure 2B:
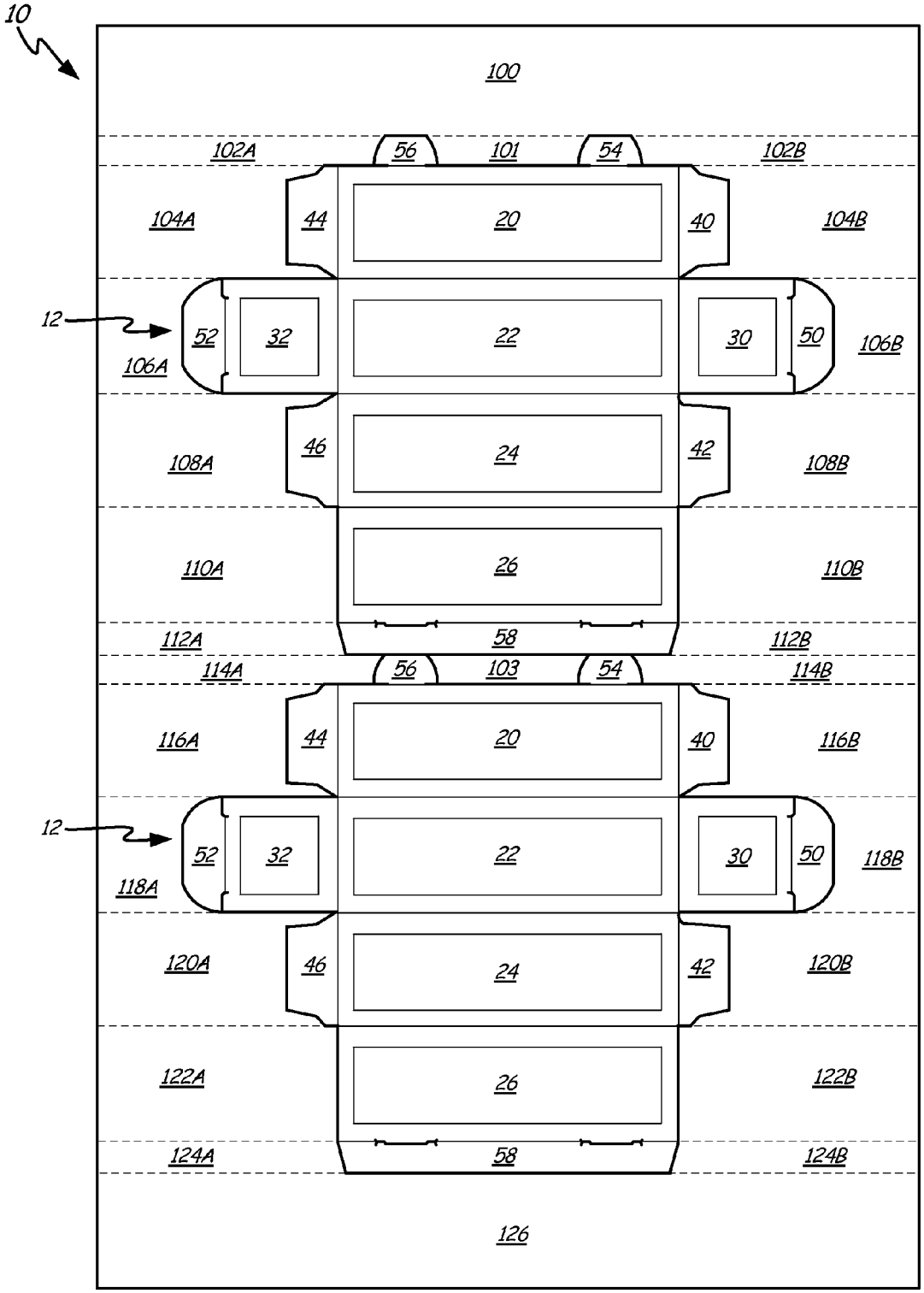
FIG. 2B is a top view of the printable blank sheet seen in FIG. 2A, having two box flats placed upon the sheet.

FIGS. 2A-2B are top views of sheet 10, which contains two box flats 12 for printing. FIG. 2A shows the perforated, scored and die-cut lines on sheet 10. FIG. 2B shows the areas that define two box flats 12 and the areas that define the excess sheet. FIG. 2A includes run-out perforations R (R10, R12, R14, R16, R18, R20, R22, R24, R26, R28, R30, R32 and R34), perforations P (P10, P12, P16, P18, P20, P22, P24, P26, P28, P30, P32, P34, P36, P38, P40, P42 and P44), scored lines S (S10A, S10B, S12, S14, S16, S18, S20, S22, S24, S26, S28, S30, S32 and S34) and die-cut lines D (D10 and D12). FIG. 2A also shows print areas PA. Sheet 10 can be made of paper, plastic, or any other suitable material that is capable of being printed on. Run-out perforations R run longitudinally across sheet 10 from one side to the other side. Run-out perforations R can be of any suitable weight, including micro-perforations. Perforations P surround the outline of two box flats 12 on sheet 10. Perforations P can be of any suitable weight, including micro-perforations. Scored lines S are located on box flats 12 and define where box flats 12 should be folded. Scored lines S can be of any suitable weight. Die-cut lines D are located on box flats 12 and define areas where tabs can be inserted to hold boxes 12 together once they are formed into three-dimensional structures. Print areas PA are the areas on box flats 12 that are capable of being printed on without printing on the run-out perforations R, perforations P, scored lines S or die-cut lines D.

Each run-out perforation R is aligned with a perforation P, a scored line S, or both. Connecting each run-out perforation R with perforations P or scored lines S allows a user to bend sheet 10 along run-out perforations R without creating unwanted fold lines across sheet 10. The only fold lines that will be made when bending run-out perforations R are folds along perforations P or scored lines S, which will be folded regardless. Folding run-out perforations R will weaken them and allow for easier detachment of box flats 12 from sheet 10.

As shown in FIG. 2B, each box flat 12 has side panels 20, 22, 24 and 26; end panels 30 and 32; side tabs 40, 42, 44, 46, 54, 56 and 58; and end tabs 50 and 52. FIG. 2B further includes sheet 10 with excess sheet areas 100, 101, 102A, 102B, 103, 104A, 104B, 106A, 106B, 108A, 108B, 110A, 110B, 112A, 112B, 114A, 114B, 116A, 116B, 118A, 118B, 120A, 120B, 122A, 122B, 124A, 124B and 126 (collectively referred to as "excess sheet areas 100-126"). Excess sheet areas 100-126 surround box flats 12. Excess sheet areas 100-126 are outlined by run-out perforations R and perforations P. Excess sheet areas 100-126 are expendable parts of sheet 10 that can be discarded when box flats 12 are removed from sheet 10.

As seen in FIGS. 2A-2B, side panel 20 has sides P14, S22, S12 and S20. On side P14, side panel 20 is connected to side tab 56 along scored line S10A and to side tab 54 along scored line SLOB. The outline of side tab 56 is defined by perforated line P10 and the outline of side tab 54 is defined by perforated line P12. Side panel 20 is connected to side tab 44 along scored line S20. The outline of side tab 44 is defined by perforated line P16. Side panel 20 is connected to side tab 40 along scored line S22. The outline of side tab 40 is defined by perforated line P18.

Side panel 22 has sides S12, S26, S28 and S14. Side panel 22 is connected to side panel 20 along scored line S12 and to side panel 24 along scored line S14. Side panel 22 is connected to end panel 32 along scored line S26 and to end panel 30 along scored line S28. End panel 32 has sides S26, P20, S24 and P24. End panel 32 is connected to end tab 52 along scored line S24. The outline of end tab 52 is defined by perforated line P22. End panel 30 has sides S28, P26, S30, and P30. End panel 30 is connected to end tab 50 along scored line S30. The outline of end tab 50 is defined by perforated line P28.

Side panel 24 has sides S14, S32, S34 and S16. Side panel 24 is connected to side panel 22 along scored line S14 and to side panel 26 along scored line S16. Side panel 24 is connected to side tab 46 along scored line S32 and to side tab 42 along scored line S34. The outline of side tab 46 is defined by perforated line P32 and the outline of side tab 42 is defined by perforated line P34.

Side panel 26 has sides S16, P36, S18 and P38. The outline of side panel 26 is defined on opposite sides by perforated lines P36 and P38. Side panel 26 is connected to side panel 24 by scored line S16. Side panel 26 is connected to end tab 58 along scored line S18. The outline of end tab 58 is defined by perforated lines P40, P42 and P44.

Sheet 10 can be run through a printer or copier to have an image printed on it. After printing, sheet 10 can be folded along run-out perforations R. When folded, run-out perforations R will weaken and separate more easily. This allows excess sheets areas 100-126 to disconnect from one another. Further, folding sheet 10 along perforations P will allow excess sheet areas 100-126 to disconnect from box flats 12. Box flats 12 will then be free-standing. The outline of box flats 12 are defined by perforations P.

Box flats 12 can be folded along scored lines S to form three-dimensional structures. Scored lines S12, S14, S16 and S18 can be folded into approximately 90 degree angles so that side panels 20, 22, 24 and 26 are at approximately 90 degree angles to the side panels they are attached to. Side tabs 54 and 56 can be folded along scored lines S10B and S10A, respectively. Side tab 54 can be inserted into die-cut line D12 and side tab 56 can be inserted into die-cut line D10. This holds boxes 12 in three-dimensional rectangular shapes. Side tabs 40, 42, 44 and 46 can be folded along scored lines S22, S34, S20 and S32, respectively, to fold side tabs 40, 42, 44 and 46 inward. End panels 30 and 32 can then be folded inward along scored lines S28 and S26, respectively, and end tabs 50 and 52 can be folded inward along scored lines S30 and S24, respectively. End tab 50 can be inserted into the gap that is formed between side panel 26 along perforated line P38 and the rest of the box. End tab 52 can be inserted into the gap that is formed between side panel 26 along perforated line P36 and the rest of the box.

Folding sheet 10 along run-out perforations R allows box flats 12 to be easily disconnected from sheet 10. Run-out perforations R prevent tearing in box flats 12 when trying to disconnect them from sheet 10. By creating an easier and more effective way to disconnect box flats 12 from sheet 10, businesses can more easily create custom print materials to use in their marketing campaigns. Being able to create their own custom printed materials provides businesses with easy and cheap ways to market their businesses, versus the costly alternative of having to send any custom print orders to print shops, which can be time consuming and expensive.

Figure 3:
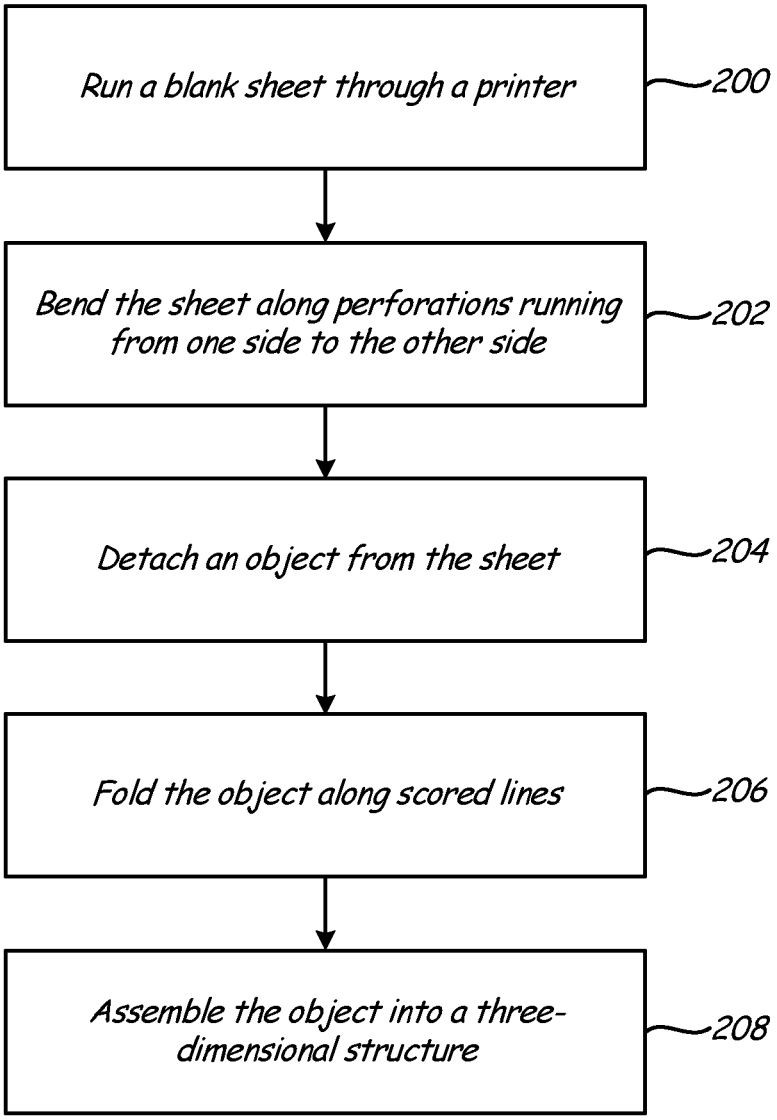
FIG. 3 is a flow chart that shows how a custom print three-dimensional object can be formed from a printable blank sheet.

FIG. 3 is a flow-chart showing the steps required to form a three-dimensional structure from a printable blank sheet. Steps 200, 202, 204, 206 and 208 show how businesses can create their own custom print marketing materials from printable blank sheets.

Step 200 includes running a blank sheet through a color printer or copier. The blank sheet can be made of paper, plastic, or any other suitable material that is capable of being printed on. The sheet will include the outline of an object defined by perforated lines and will have run-out perforations running from one side of the sheet to the other side. Both the perforations surrounding the object and the run-out perforations can be of any suitable weight. The blank sheet will be supplied to the user with scored lines and perforations from a manufacturer. The blank sheet will also have areas that are capable of being printed on so that the object can be custom printed. Prior to printing on the sheet, a template on a computer can be used to create the custom image that is to be printed on the sheet. The sheet will also have scored lines that define where the object can be folded to create a three-dimensional structure. The scored lines can be any suitable weight.

Step 202 includes bending the sheet along run-out perforations that run from one side of the sheet to the other side of the sheet. The sheet should be folded along the run-out perforations in an alternating manner, so that the resulting folded structure resembles a fan. The sheet should then be flattened out and folded along the run-out perforations in the opposite direction, again resembling a fan structure when completely folded. The sheet should then once again be flattened out, allowing the run-out perforations to break apart.

Step 204 includes detaching an object from the sheet. As stated above, the outline of the object will be defined by a set of perforated lines. To detach the object from the sheet, the excess sheet areas should be folded along the perforated lines surrounding the object, so that the excess sheet areas can be detached from the object. The excess sheet areas will already be partially detached after the sheet was folded along the run-out perforations.

Step 206 includes folding the object along scored lines. As stated above, the object will have scored lines that define where the object should be folded in order to form a three-dimensional structure. To form the three-dimensional structure, the object needs to be folded along each scored line. The scored lines should all be folded into approximately 90 degree angles. Each scored line should be folded inward, so that the blank sides of the object are folded towards each other. This allows the custom printed areas of the object to remain visible.

Step 208 includes assembling the object into a three-dimensional structure. To do this, side tabs and end tabs attached to the object need to be inserted into die-cut slots that will hold them in place. The only parts of the object that should remain visible after tucking the side tabs and end tabs into their designated slots should be four side panels and two end panels.

This method provides an efficient and effective way to form custom print three-dimensional structures from printable blank sheets. Using this method, businesses will be able to create custom marketing materials at a lower cost and in a time-efficient manner. Compared to the traditional die-cut objects, the new method allows for great accuracy and less chance that the object will be torn when trying to detach it from the excess sheet areas. This method increases the incentive for businesses to create their own custom print marketing materials by providing presentable and strong final products.

Figure 4:
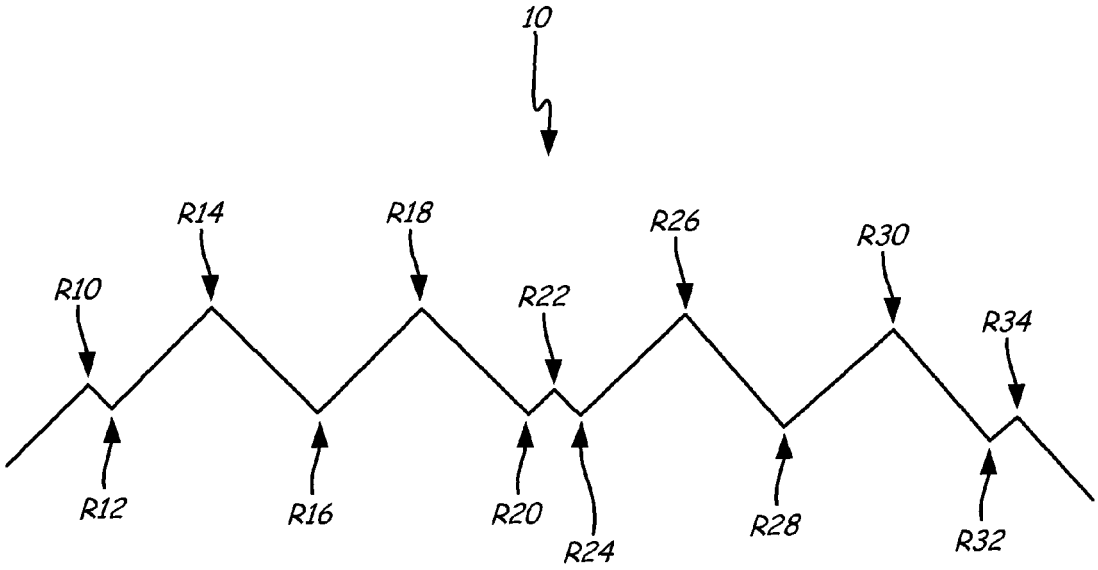
FIG. 4 is a side view of a printable blank sheet that is folded along run-out perforations.

FIG. 4 is a side view of sheet 10 when it is partially folded along run-out perforations R (R10, R12, R14, R16, R18, R20, R22, R24, R26, R28, R30, R32 and R34). Each run-out perforation R runs from one side of sheet 10 to the other side and is interrupted by a portion of box flats 12. Run-out perforations R partially define excess sheet areas 100-126 that are to be detached from box flats 12.

As seen in FIG. 4, sheet 10 can be folded along each run-out perforation R in an alternating manner. When sheet 10 is completely folded along run-out perforations R it should resemble a fan. Folding sheet 10 weakens run-out perforations R so that they can be easily separated. Separating sheet 10 along run-out perforations R allows box flats 12 to easily separate from sheet 10 without tearing. This creates a stronger and more presentable final structure.

Figure 5A:
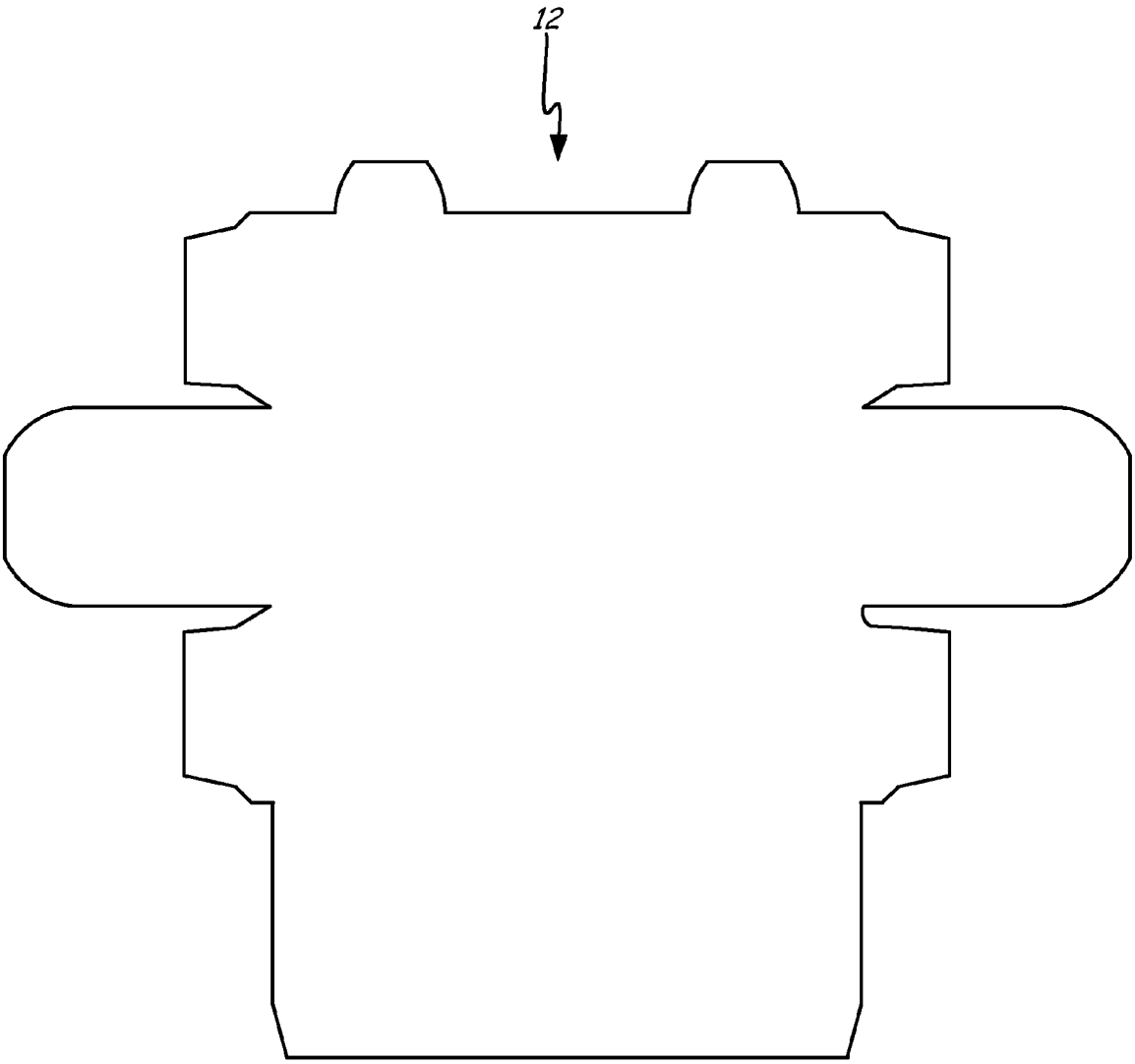
FIG. 5A is a top view of a die-cut box flat after it has been removed from a sheet utilizing the current invention.
Figure 5B:
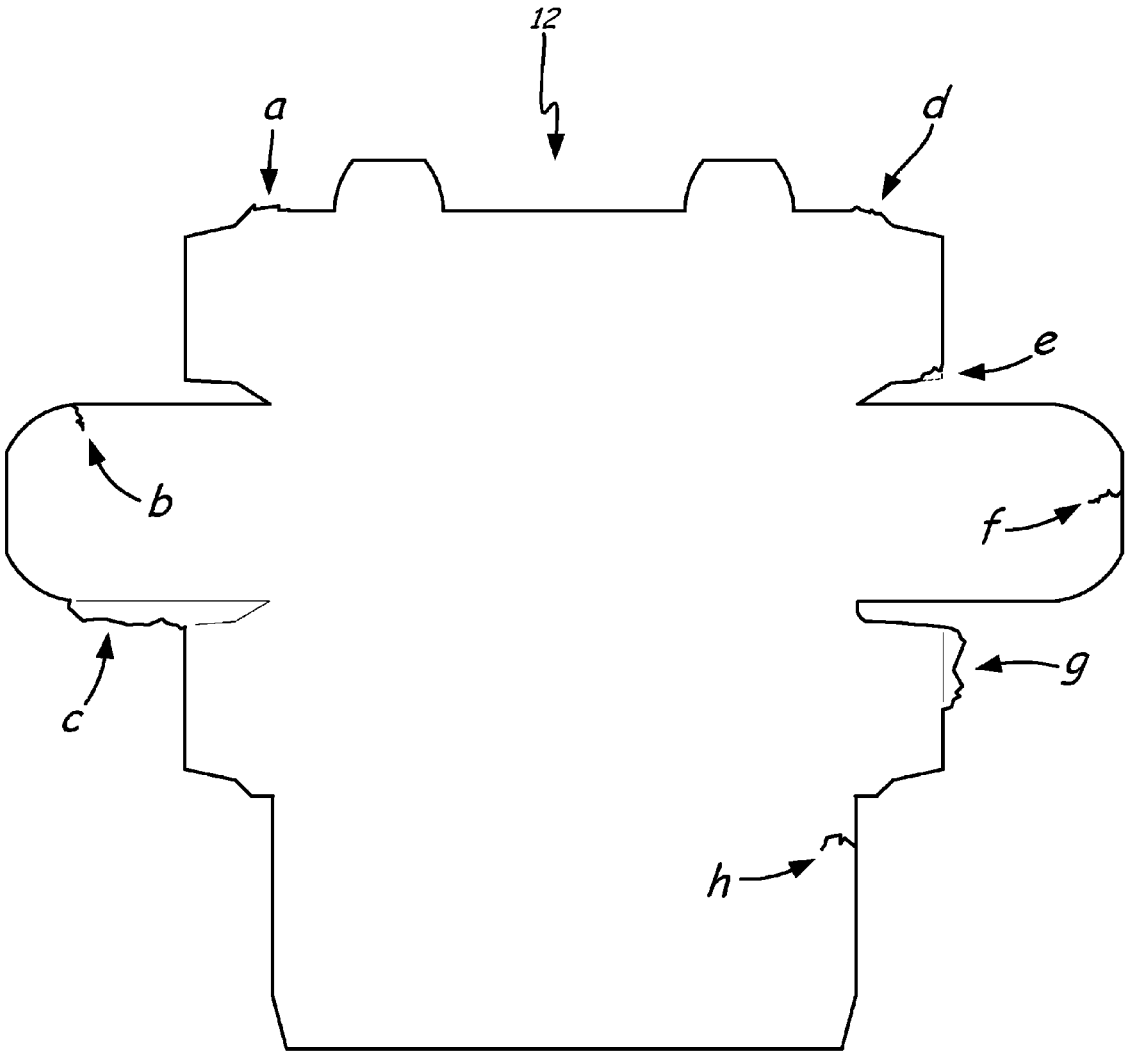
FIG. 5B (PRIOR ART)
FIG. 5B is a top view of a die-cut box flat after it has been removed from a sheet utilizing the traditional die-cut template without run-out perforations.

FIG. 5A shows die-cut box flat 12 after it has been removed from sheet 10 using the current invention. FIG. 5B shows identically shaped die-cut box flat 12 after it was removed from a sheet using the traditional die-cut template without run-out perforations R. As seen in FIG. 5A, when box flat 12 is separated from excess sheet areas 100-126 using the invention, there is minimal tearing of box flat 12. As seen in Table 1, the average number of tears per box flat 12 when using the new invention is 0.3 tears per object.

TABLE 1

Number of tears per product with new invention.

| Sample Number | Errant Tears | Usable Product? |
|---|---|---|
| 1 | 0 | Yes |
| 2 | 1 | Yes |
| 3 | 2 | No |
| 4 | 0 | Yes |
| 5 | 1 | Yes |
| 6 | 0 | Yes |
| 7 | 0 | Yes |
| 8 | 0 | Yes |
| 9 | 0 | Yes |
| 10 | 0 | Yes |
| 11 | 0 | Yes |
| 12 | 0 | Yes |
| 13 | 0 | Yes |
| 14 | 0 | Yes |
| 15 | 0 | Yes |
| 16 | 0 | Yes |
| 17 | 0 | Yes |
| 18 | 1 | Yes |
| 19 | 1 | Yes |
| 20 | 0 | Yes |

As seen in FIG. 5B, when the traditional die-cut template without run-out perforations is used, there is significant tearing of box flat 12, as evident by tears a, b, c, d, e, f, g and h. FIG. 5B is an actual representation of the tears in box flat 12 that were seen in one round testing. As seen in Table 2, the average number of tears per box flat 12 when using the traditional die-cut template equals 6.4 tears per box flat.

TABLE 2

Number of tears per product with traditional die-cut product.

| Sample Number | Errant Tears | Usable Product? |
|---|---|---|
| 1 | 7 | No |
| 2 | 5 | No |
| 3 | 4 | No |
| 4 | 4 | Yes |
| 5 | 7 | No |
| 6 | 6 | No |
| 7 | 8 | No |
| 8 | 4 | No |
| 9 | 7 | No |
| 10 | 7 | No |
| 11 | 6 | Yes |
| 12 | 4 | Yes |
| 13 | 6 | No |
| 14 | 7 | No |
| 15 | 8 | No |
| 16 | 7 | No |
| 17 | 8 | No |
| 18 | 8 | No |
| 19 | 3 | Yes |
| 20 | 12 | No |

As evident from the test data above, the invention is a great improvement over the prior die-cut template without run-out perforations. To detach the prior die-cut template, one had to be careful to tear box flat 12 out of sheet 10 only around perforations P. This is difficult to do since perforations P are irregularly placed on the sheet and there is no way to easily fold the sheet along perforations P to weaken perforations P. The invention allows a user to split excess sheet areas 100-126 into different pieces by first folding them along run-out perforations R. This allows a user to fold excess sheet areas 100-126 along perforations P that surround the object so that perforations P can weaken before they are torn. This provides a lesser chance of tearing box flat 12 and a more presentable and usable product in the end, while still allowing a user to custom print their own image on sheet 10.

While the invention has been described with reference to golf ball sleeve box 12 with a specific shape and size, any die-cut object that is capable of being formed from a flat sheet into a two-dimensional or three-dimensional structure can be placed on the printable blank sheet. Examples can include business cards, postcards, candy boxes, door hangers or pop-up calendars. The sheet was described with reference to a particular material, shape and size, but the sheet can be made of any material that is capable of being printed on and can be any size and shape that is capable of being run through a printer or copier.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method for creating custom print structures, the method comprising:

running a printable blank sheet through a printer to print on defined print areas of the blank sheet, wherein the blank sheet includes outline perforation lines defining a periphery of an object in the sheet, run-out perforation lines extending from the periphery to edges of the sheet, and scored fold lines in the object;

bending the sheet along the run-out perforation lines, wherein the run-out perforations will weaken and break apart, and wherein bending the sheet along the run-out perforation lines will also bend each scored fold line that defines a boundary between two side panels in the object;

detaching an object from the sheet;

folding the object along scored lines; and assembling the object into a structure.

2. The method of claim 1, and further comprising:

using a computer template to prepare the image that is to be printed on the sheet.

3. The method of claim 1, wherein the run-out perforation lines are micro-perforations.

4. The method of claim 1, wherein the outline perforation lines are micro-perforations.

5. The method of claim 1, wherein the object can be assembled into a three-dimensional structure through the use of tabs and cut lines.

* * * * *